US006859944B2

(12) United States Patent
Kim

(10) Patent No.: US 6,859,944 B2
(45) Date of Patent: Mar. 1, 2005

(54) APPARATUS FOR ADJUSTING COVERAGE OF A PORTION OF A BODY OF A WEARER IN AN ARTICLE OF CLOTHING

(75) Inventor: Young Kim, Guttenberg, NJ (US)

(73) Assignee: JeanJear LTD, New York, NY (US)

( * ) Notice: Subject to any disclaimer, the term of this patent is extended or adjusted under 35 U.S.C. 154(b) by 0 days.

(21) Appl. No.: 10/238,766

(22) Filed: Sep. 10, 2002

(65) Prior Publication Data

US 2004/0045077 A1 Mar. 11, 2004

(51) Int. Cl.[7] ..... A41F 9/00
(52) U.S. Cl. ..... 2/237
(58) Field of Search ..... 2/67, 69, 69.5, 2/70, 71, 72, 73, 74, 75, 78.1, 78.4, 79, 80, 83, 85, 90, 96, 77, 100, 105, 106, 108, 211, 212, 213, 217, 218, 219, 220, 221, 400, 405, 406, 227, 234, 235, 236, 237, 238, 228, 269, 270, 271; 450/119, 120, 121, 134, 136, 141, 147, 155; 24/72.1, 91, 129 A, 712.1

(56) References Cited

U.S. PATENT DOCUMENTS

| | | | | | |
|---|---|---|---|---|---|
| 57,950 | A | * | 9/1866 | Moody | 2/217 |
| 155,195 | A | * | 9/1874 | Lindauer | 2/235 |
| 761,200 | A | * | 5/1904 | Bush | 2/221 |
| 964,697 | A | * | 7/1910 | Rogers | 2/407 |
| 1,116,307 | A | * | 11/1914 | Lynch | 2/269 |
| 1,157,265 | A | * | 10/1915 | Tutelman | 2/269 |
| 1,182,425 | A | * | 5/1916 | Rubinstein | 2/269 |
| 2,280,467 | A | * | 4/1942 | Blanc | 2/162 |
| D136,860 | S | * | 12/1943 | Walker | D2/737 |
| 2,430,877 | A | * | 11/1947 | Kay | 450/69 |
| 2,431,809 | A | * | 12/1947 | Koret | 2/106 |
| 2,470,678 | A | * | 5/1949 | Auslender | 2/105 |
| 2,484,467 | A | * | 10/1949 | Schacht | 450/69 |
| 2,507,463 | A | * | 5/1950 | Smith | 2/76 |
| 2,626,396 | A | * | 1/1953 | Kanin | 2/269 |
| 2,632,177 | A | * | 3/1953 | McFerin | 2/406 |
| 2,675,554 | A | * | 4/1954 | Gertz | 2/80 |
| 2,687,530 | A | * | 8/1954 | Farnum | 2/217 |
| 2,692,988 | A | * | 11/1954 | Rouse | 2/73 |
| 3,045,246 | A | * | 7/1962 | Hoff | 2/269 |
| 3,654,630 | A | * | 4/1972 | Block | 2/67 |
| 3,812,539 | A | * | 5/1974 | Muehlberg et al. | 2/69.5 |
| 4,149,275 | A | * | 4/1979 | Sanchez | 2/269 |
| 4,294,257 | A | * | 10/1981 | Rennhofer | 450/71 |
| 4,773,101 | A | * | 9/1988 | Kapp et al. | 2/69.5 |
| 4,774,726 | A | * | 10/1988 | Garrett | 2/105 |
| 4,967,454 | A | * | 11/1990 | Elieff | 24/712.1 |
| D337,194 | S | * | 7/1993 | Marks | D2/738 |
| 5,299,323 | A | * | 4/1994 | Schaefer et al. | 2/93 |
| 5,315,712 | A | * | 5/1994 | McTaggart | 2/106 |
| 5,367,709 | A | * | 11/1994 | Teasley | 2/69 |
| 5,539,932 | A | * | 7/1996 | Howard | 2/269 |
| 5,787,511 | A | * | 8/1998 | Garside | 2/269 |
| 6,282,717 | B1 | * | 9/2001 | Ng | 2/70 |
| 6,317,894 | B1 | * | 11/2001 | Blechman | 2/269 |

* cited by examiner

*Primary Examiner*—John J. Calvert
*Assistant Examiner*—Alissa L. Hoey
(74) *Attorney, Agent, or Firm*—Cottlieb, Rackman & Reisman, P.C.

(57) ABSTRACT

A device and article of clothing to adjust the article to reveal a portion of the body such as an abdominal area is disclosed. In the preferred embodiment a means for adjusting is a cinch device including an elastic cord with mating snaps on a the cord and article of clothing. The cord is attached through an adjustable section of material in a manner to permit the material to be gathered or bunched together when the cord is drawn. The cinch is selectively securable by the snaps in one or more positions. In a preferred pants embodiment of the invention, the adjustment changes the distance between the waistline and crotch of the pants to increase or decrease the distance between the waistline and crotch to variably cover or reveal the lower abdominal area of the wearer.

15 Claims, 3 Drawing Sheets

FIG. 1
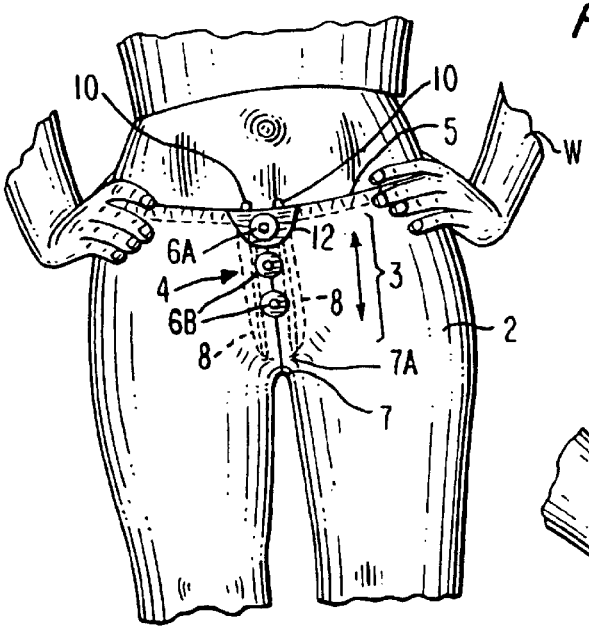
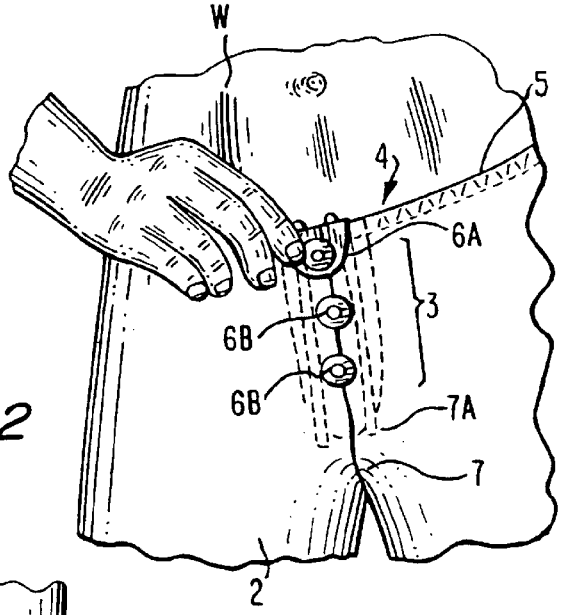
FIG. 2
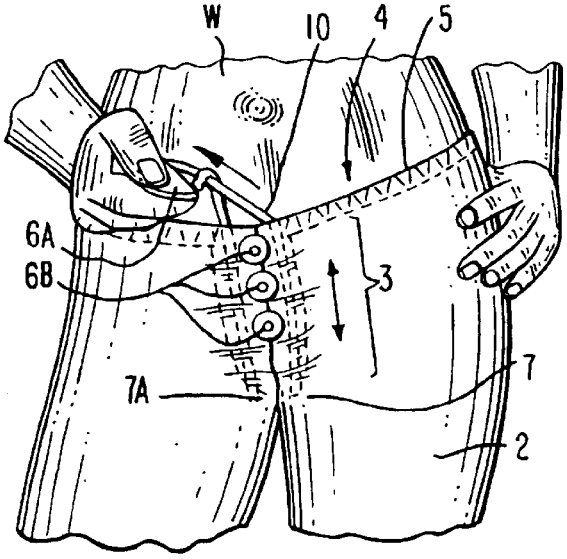
FIG. 3

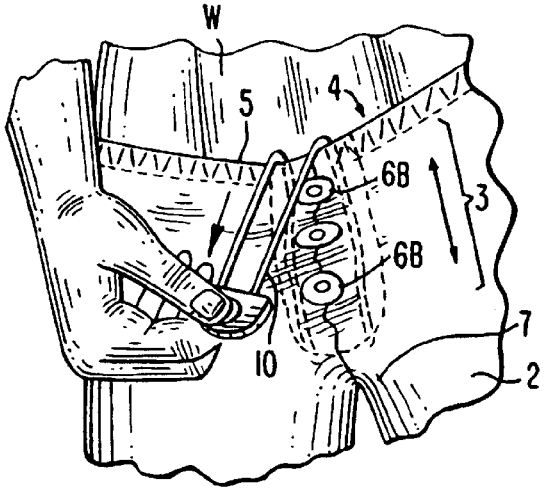
FIG. 4
FIG. 5
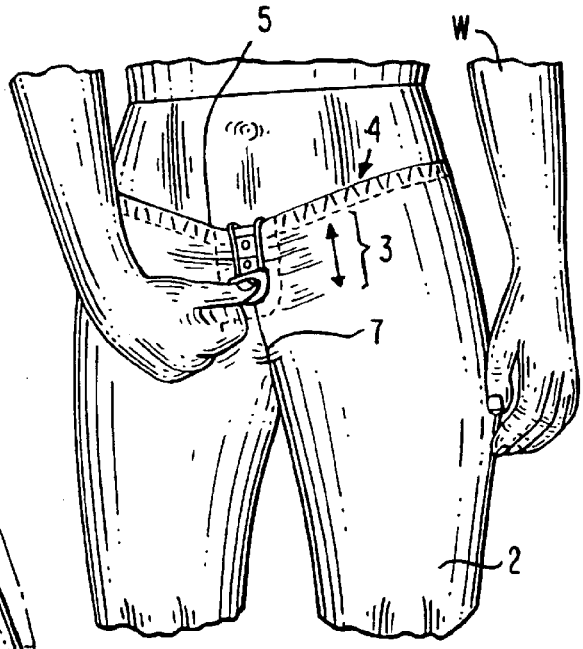
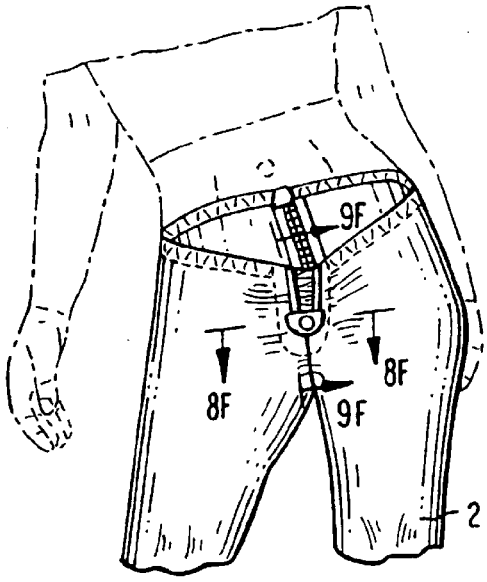
FIG. 6

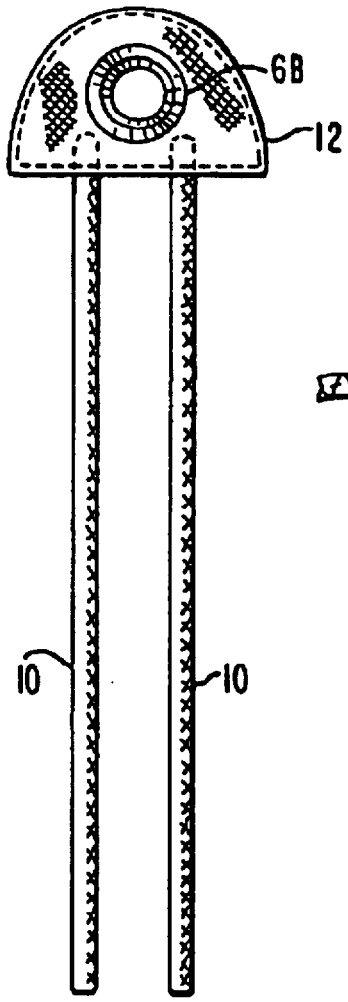
FIG. 7
FIG. 8
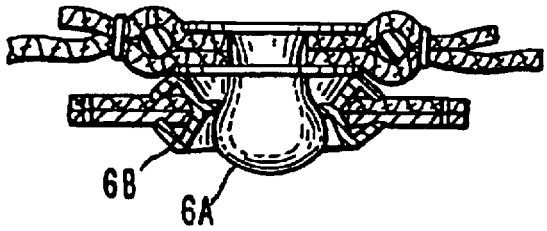
FIG. 9
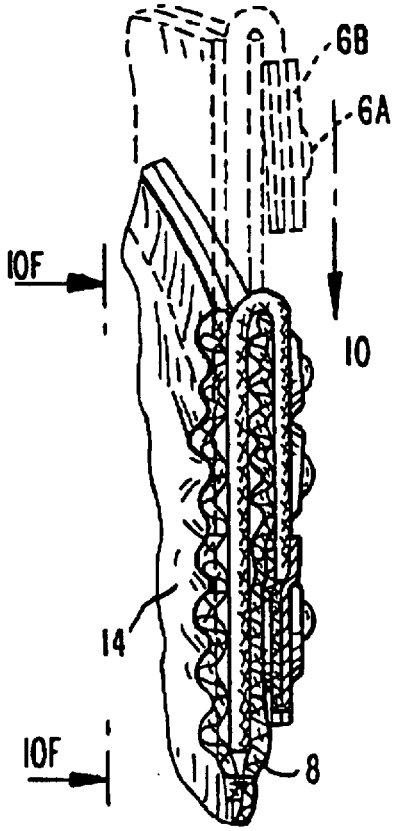
FIG. 10
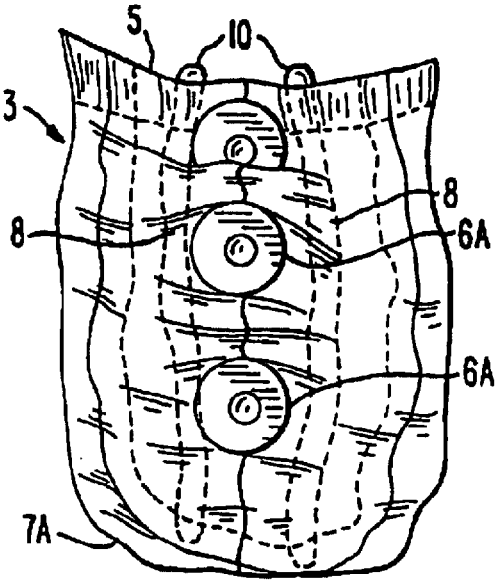

APPARATUS FOR ADJUSTING COVERAGE OF A PORTION OF A BODY OF A WEARER IN AN ARTICLE OF CLOTHING

FIELD OF INVENTION

This invention relates to a devices for adjusting the fit an article of clothing. More specifically, the invention involves a device for gathering a section of material in pants, jeans, skirts and other articles of clothing to adjust a degree of coverage to selectively reveal a portion of the body such as the midriff or lower abdominal areas.

BACKGROUND OF THE INVENTION

Since the cultural revolution of the 1960s, Western society has become more open and tolerant to ideas that challenge traditional concepts. One forum for the expression of change that confronts tradition is fashion. For instance, the casualization of the work place has brought with it a decline to the formality previously associated with dress suits, jackets and ties that have been a staple to the corporate world for over a century.

Another such example of liberalism in fashion is the evident increase in outfits that increasingly display previously hidden portions of the body through the tailored reduction of material. The development of the bikini from the bathing suit is one such example of this design concept. Miniskirts and short dresses are another. Overall, fashions that reveal and emphasize the body and its natural curves and characteristics are extremely popular. Both men and women find attire that exposes or accentuates the body to be very appealing.

A more current trend in style is an increased exposure of the torso, hips and abdominal area of the body. In the context of pants, jeans, shorts, skirts, and other apparel, the waistlines on these articles have been recently lowered to reveal more by cutting excess material to reduce the size of the article of clothing. For instance, designers, manufacturers and distributors in the jeans industry, make 'low-rise' and 'extra low-rise' jeans for women with many variations in color, preparation and degree of tightness in the leg and seat area. However, due to the highly varying shapes and sizes of women and differences in the manufacturing process, finding the right fit for any individual is difficult. Some jeans may rest lower or higher on the waist than others and hence reveal more or less midriff than desired. In short, the right cut is hard to find.

Even if an appropriate cut can be found, a lack of adjustability due to nature of the cut limits usefulness. For example, while a greater degree of body exposure may be desired at certain times during the day, more coverage at other times might be desired. This cannot be accomplished by material reduction without having several outfits. Thus, a reduction of material on more traditional articles of clothing is not a sufficiently dynamic solution.

The solution of simply wearing pushed down clothing cannot effectively address these issues. Since these articles are not designed to be worn in this manner, the approach tends to be uncomfortable for the wearer. Moreover, the clothing will inevitably return to its natural position during movement.

In sum, current articles of clothing lack a dynamic design to provide for comfort, support, style and fit to satisfy the contemporary desire for adjustably revealing apparel.

BRIEF DESCRIPTION OF THE INVENTION

In view of the prior art deficiencies, an objective of the present invention is to provide an article of clothing and associated device to increase abdominal or midriff exposure.

A further objective of the present invention is to provide such an article and device that is adjustable to accommodate different body sizes and to vary a degree of exposure.

A still further objective of the present invention is to provide such a device appropriate for use in various types of clothing including pants, jeans, shorts, shirts and skirts.

Additional objectives will be apparent to those skilled in the art from the description of the invention as contained herein.

In its broadest aspects, the invention is an article of clothing and a device for adjusting the article to reveal a portion of the body such as an abdominal area. In the preferred embodiment the means for adjusting is a cinch. The device preferably includes a cord attached through an adjustable section of material in a manner to permit the material to be gathered or bunched together when the cord is drawn. The cinch has a means for securing that allows the cord to be secured in one or more positions. In a preferred pants embodiment of the invention, the adjustment changes the distance between the waistline and crotch of the pants to increase or decrease the distance between the waistline and crotch to variably cover or reveal the lower abdominal area of the wearer. In this preferred embodiment of the invention an elastic cord is provided with snaps including a ring sized to couple or interlock with nipples on the pants.

BRIEF DESCRIPTION OF THE DRAWINGS

FIG. 1 depicts a preferred embodiment of the cinch of the invention in a pair of pants on a wearer;

FIG. 2 illustrates a wearer unfastening the preferred embodiment of the cinch of FIG. 1;

FIG. 3 illustrates a wearer adjusting the preferred cinch of FIG. 1;

FIG. 4 illustrates the adjustment of a degree of exposure of the lower abdomen and gathering of material of the article of clothing of the embodiment of the cinch of FIG. 1;

FIG. 5 shows the wearer securing a cinch of FIG. 1 in a position to increase exposure;

FIG. 6 is a front elevated view of a portion of the cinch device and pants of FIG. 1 in the gathered position of FIG. 5;

FIG. 7 is an enlarged view of a cord portion of the cinch of FIG. 1;

FIG. 8 is a fragmented sectional view of a secured portion of the cinch and pants of FIG. 1 taken along lines 8—8 of FIG. 6;

FIG. 9 is a partial lateral view of the cinch and pants of FIG. 1 taken along lines 9—9 of FIG. 6 depicting a degree of adjustment between a gathered position and an ungathered position;

FIG. 10 is an internal rear view of the cinch and a portion of the pants of FIG. 1 in a gathered position taken along lines 10—10 of FIG. 9.

DETAILED DESCRIPTION OF THE INVENTION

A preferred embodiment an article of clothing for adjusting the coverage of a portion of the body to adjustably reveal more or less of a body part is generally depicted in FIGS. 1–6. The apparatus includes an article of clothing such as a pair of pants 2 and includes a type of cinch 4. Various components of a preferred embodiment of the cinch of the invention are shown in FIGS. 7–10.

In the preferred embodiment of the invention, the cinch 4 provides an adjustment function for adjusting an adjustable section 3 of material of an article of clothing. For example, in a pair of pants worn by a user as shown in FIGS. 1–6, the cinch 4 is capable of adjusting a portion of the waistline 5 of the pants 2 by gathering the adjustable section 3 of material in an approximately vertical manner when worn by a user to decrease the coverage area of a portion of the body adjacent to the adjustable section 3 of material to reveal or expose the portion of the body. In this way, the pants 2 are adjustable to selectively reduce or increase the distance between the waistline 5 and the crotch 7. In FIGS. 1–6, the section of material is shown in different positions to reveal or cover a varying portion of the lower abdomen of the wearer W. FIG. 1 depicts the invention in a full coverage position relative to the partial coverage position or revealing position of FIG. 5.

The preferred cinch 4 includes a cord 10 as a means for adjusting the article of clothing. The length of the cord may be chosen so that it is sufficient to bunch or gather a desired section of material when the cinch 4 is adjusted to a partial coverage or revealing position of FIG. 5 as well as allow the material to return to the full coverage position of FIG. 1. While only one cord 10 is needed for the cinch 4 and more cords can be used, a preferred embodiment of the invention utilizes two separate cords as seen in the figures which jointly gather the material in the front section of the pants 2. By spacing multiple cords, they providing for a broader surface area for adjusting the adjustable section 3 of the material of the article of clothing.

The cord 10 may be constructed from a variety of materials or combinations thereof. Typically, the cord 10 is composed from traditional natural and synthetic fibers. However, leather, rubber, fabric, plastic and other natural and synthetic materials may be utilized as well. Basically, provided that the cord 10 is of a material that is capable of providing the adjustment described herein, it may be used as a cord 10. It is understood that other devices may be substituted for the cord 10 which would be equally acceptable for accomplishing the adjustment aspects of the invention. For example, a strap or belt could serve as part of the cinch 10.

In a preferred embodiment, the cord 10 is composed of an elastic material. A cord 10 comprised of elastic can achieve a greater degree of extension than its non-elastic counterpart and can therefore make securing the cinch 4 easier for the user. Moreover, a more stable hold of the adjustable sections of material may be achieved when the cord 10 is secured with a securing means since the securing means will be less likely to release accidentally during body movement since the cord 10 itself will tend to stretch with movement before the securing means will inadvertently release.

The cord 10 is fixed to a fixed portion 7*a* of the adjustable section 3 of material to permit the section of material to gather or bunch in relation to the cord 10. For example, the cord 10 may reside within a channel 8 or channels made from an additional layer of material in the pants 2. The channel 8 is part of the adjustable section 3 of the material of the pants 2. At an end of the channel 8 the cord 10 is attached to the fixed portion 7*a*. In the embodiment of the invention shown in the figures, the fixed portion 7*a* is near the crotch 7 of the pants. In this way, the adjustable section 3 of material may gather in relation to the action of the cord from the waistline 5 towards the fixed portion 7*a* near the crotch 7 of the pants 2.

Although other ways of integrating the cord 10 and adjustable section 3 to permit gathering of the adjustable section 3 of the material of the pants 2, the channel 8 has advantages particularly over embodiments without such a feature. Channels offer a generally permanent site for housing the cord 10. This prevents the cord 10 from shifting freely and rubbing or irritating the wearer's skin in the vicinity of the cord 10. Furthermore, locating the cord 10 in a channel 8 or channels prevents lateral movement of the cord and thus provides consistency of performance so that the gathered article of clothing will have a consistent appearance. It also promotes a smother more even look by restricting the size of the folds 14 of gathered material.

The preferred cinch 4 also serves the function of securing the adjustment achieved with the cord 10 as just described. For this function, a means for securing 6*a*, 6*b* the cord 10 is incorporated with the cord 10. Generally, the means for securing 6*a*, 6*b* prevents the gathered material from reverting back to an ungathered position. Many different fasteners of engaging members are appropriate as a means for securing 6*a*, 6*b* to the cord 10. However, they are preferred to be relatively simple to fasten and unfasten so that a user can adjust the cinch 4 with minimal effort.

In the embodiment shown in the figures, a securing device is fixed to a portion of the cord 10 opposite to the portion of the cord that is attached to the fixed portion 7*a* of the adjustable section 3 of material of the pants 2. This preferred embodiment of the means for securing 6*a*, 6*b* includes reciprocal devices for coupling with the cord 10 arranged on the adjustable section 3 of material of the pants 2. For example, in a preferred embodiment of the cinch 4, snaps are used to fasten the cord 10. In this version, one or more nipples 6*b* or protruding members located on the front exterior section of the pants 2 are sized to connect or couple together with a ring 6*a* affixed on the cord 10. Obviously, the ring 6*a* on the cord 10 may be switched with the protruding members on the pants 2. Also, other securing means may be used in addition to or instead of snaps, such as buttons, hooks, clasps, clamps, clips, latches, Velcro, etc.

Of course, the means for securing 6*a*, 6*b* need not have separate pieces as just disclosed. Other means may be used, for example, an adjustable crimping device on the cord 10 may be used to prevent the section of material from ungathering once it has been gathered to varying degrees on the cord 10 to lower the waistline 5 of the pants 2 to the crotch 7.

In the preferred embodiment of the invention as shown in the figures, several nipples 6*b* are arranged on the adjustable section 3 of material of the pants 2 to provide varying degrees of adjustment to the gathering of the adjustable section 3. In the preferred embodiment, three nipples are used. When used, the nipple proximate to the waistline 5 of the pants 2 does not result in gathering of the adjustable section 3. Use of the furthest nipple from the waistline 5 results in the greatest degree of gathering, i.e., the greatest degree of reduction in the distance from the waistline 5 to the crotch 7. The middle nipple between the previously mentioned nipples will result in a smaller degree of gathering. Additional nipples 6*b* may be provided to provide for a greater degree of variation in the distance.

In the preferred embodiment of the invention a tab 12 surrounds the ring 6*a* and fixed to the cord 10. The tab provides a larger surface area adjacent to the ring 6*a* to make manipulation of the ring 6*a* easier. It may be formed with a section of fabric, leather, plastic, metal or other materials.

Use of an embodiment of the invention is illustrated by examination FIGS. 1–5 in sequence. As shown in FIG. 2, a wearer W disengages a ring 6*a* on the cord from its position on the nipple nearest to the waistline of the pants 2. Then, in FIG. 3, the wearer W uses the cord 10 to gather adjustable section 3 of the pants 2 as the cord 10 moves through the channel 8. As the cord 10 is pulled, material gathers in a direction as shown in FIGS. 3 and 4. The cinch 4 keeps the material bunched together when secured by ring 6*a* and nipple as shown in FIG. 5. In this gathered position, the cord 10 is snapped into place.

With this invention a wearer W can adjust a degree of desired exposure of the lower abdominal area. The cinch 4 eliminates the problems associated with manually pushing down a front area of pants in an attempt to show more of a lower abdominal area. The cinch maintains desired exposure without the gathered material creeping up from the wearer's movement.

The cinch 4 is particularly valuable as it gives each pair of pants a heightened degree of versatility by allowing varying levels of adjustment. For individuals where it would be inappropriate to expose an abundance of the midriff area, such as at work or in an office environment, the pants may be adjusted for minimal exposure. In other more suitable surroundings, the pants may be adjusted to expose more of the abdominal area, such as at the beach or in a club. Additionally, the adjustment feature provides versatility to assist in accommodating women of different sizes.

Although this invention has been described with reference to a particular embodiment, it is to be understood that this is merely illustrative of an application of the principles of the invention. Numerous modifications to the embodiments discussed herein may be made and other arrangements may be devised without departing from the spirit and scope of the invention. For example, the invention of variations thereof may be used in skirts, shorts or shirts to provide the ability to reveal more or less of a body part proximate to the adjustable section of the article of clothing.

I claim:

1. An apparatus for adjusting a coverage of a portion of the body of a wearer comprising:

a material so formed to comprise an article of clothing, said material having an adjustable section, said adjustable section designed with a coverage area in said article of clothing, said coverage area to conceal a portion of a body of a wearer;

a cord comprised of two seperate lengths with a fixed portion and an engaging portion, wherein said fixed portion is attached through said adjustable section and fixed thereto;

a first engaging member on said engaging portion of said cord; and a plurality of second engaging members arranged on said adjustable section of said material, wherein each of said second engaging members are selectively engagable with said first engaging member, whereby selectively engaging said first engaging member to at least one of said second engaging members will gather said adjustable section of material to reduce said coverage area to reveal said portion of a body of a wearer.

2. The apparatus of claim 1 wherein said article of clothing is a pair of pants.

3. The apparatus of claim 2 wherein said portion of a body is a lower abdomen.

4. The apparatus of claim 3 wherein said plurality of second engaging members are arranged to provide different degrees of exposure of said portion of a body of a wearer.

5. The apparatus of claim 4 wherein said first engaging member and said plurality of second engaging members comprise snaps.

6. The apparatus of claim 5 wherein said cord is comprised of an elastic material.

7. The apparatus of claim 6 wherein said first engaging member comprises a ring.

8. The apparatus of claim 7 wherein each of said plurality of second engaging members comprises a protruding portion sized to interlock with said ring.

9. The apparatus of claim 8 wherein said adjustable section comprises a channel sized to receive said two separate lengths of said cord.

10. An adjustable article of clothing comprises:

A material with a front section having a coverage area to conceal a lower abdominal area of a wearer;

a means for adjusting said front section affixed to be a part of said front section; and a means for selectively securing said means for adjusting affixed to be a part of said material and said means for adjusting, wherein said means for adjusting reduces or increases said coverage area of said front section by gathering or ungathering said material in said front section to reduce or increase coverage of said lower abdominal area to reveal more or less of said lower abdominal area, wherein said material comprises a pair of pants, said means for adjusting comprises a cord and wherein said means for selectively securing comprises a ring.

11. The adjustable of clothing of claim 10, where said cord is comprised of two separate lengths.

12. The adjustable article of clothing of claim 11 wherein said front section comprises a channel sized to receive said separate lengths of said cord.

13. The adjustable article of clothing of claim 10 wherein said means for selectively securing further comprises a plurality of protruding members sized to interlock with said ring.

14. The adjustable article of clothing of claim 13 wherein said plurality of protruding members is arranged to provide a different coverage area at said front section when each of said plurality of protruding members is interlocked with said ring.

15. An article of clothing comprising:

a pair of pants with a front section designed for coverage of a lower abdominal area of a wearer;

a cord through a channel in said front section, said cord fixed at one end of said channel in said front section;

a tab and ring attached to an end of said cord;

a plurality of nipples each sized to engage said ring;

wherein said nipples are arranged on said front section and a length of said cords are chosen so that said front section gathers approximately vertically when worn to decrease said coverage of said lower abdominal area when said tab and ring engages at least one of said nipples thereby providing an article of clothing to adjustably reveal a lower abdominal area of a wearer.

* * * * *